US010335663B2

(12) United States Patent
DeMilio

(10) Patent No.: US 10,335,663 B2
(45) Date of Patent: Jul. 2, 2019

(54) 3-IN-1 GOLF CUP

(71) Applicant: Joseph L DeMilio, Tuckerton, NJ (US)

(72) Inventor: Joseph L DeMilio, Tuckerton, NJ (US)

(73) Assignee: Joseph L. DeMilio, Little Egg Harbor, NJ (US)

( * ) Notice: Subject to any disclaimer, the term of this patent is extended or adjusted under 35 U.S.C. 154(b) by 0 days.

(21) Appl. No.: 15/909,110

(22) Filed: Mar. 1, 2018

(65) Prior Publication Data

US 2018/0250572 A1 Sep. 6, 2018

Related U.S. Application Data

(60) Provisional application No. 62/466,845, filed on Mar. 3, 2017.

(51) Int. Cl.

| | |
|---|---|
| ***A63B 57/40*** | (2015.01) |
| ***A63B 69/36*** | (2006.01) |
| *A63B 67/02* | (2006.01) |

(52) U.S. Cl.

CPC ..... *A63B 69/3676* (2013.01); *A63B 57/40* (2015.10); *A63B 67/02* (2013.01)

(58) Field of Classification Search

CPC ..... A63B 57/40; A63B 67/02

USPC ..... 473/180, 181, 159, 160; 446/122, 123; D21/505, 790

See application file for complete search history.

(56) References Cited

U.S. PATENT DOCUMENTS

| | | | | | |
|---|---|---|---|---|---|
| 815,649 | A * | 3/1906 | Smith | A63B 57/357 | 473/180 |
| 1,612,292 | A * | 12/1926 | Jackson | A63B 67/02 | 473/181 |
| D77,020 | S * | 11/1928 | Meilicke | 473/180 | |
| 2,031,525 | A * | 2/1936 | Clarke | A63B 57/357 | 473/180 |
| 3,662,486 | A * | 5/1972 | Freedman | A63F 9/088 | 220/DIG. 13 |
| 4,691,923 | A * | 9/1987 | Schwartz | A63B 63/08 | 273/127 B |
| 5,087,046 | A * | 2/1992 | Mauch | A63B 67/02 | 206/315.2 |
| 6,398,661 | B1 * | 6/2002 | Llewellyn | A63B 63/00 | 473/180 |
| 6,623,370 | B1 * | 9/2003 | Willer | A63B 67/02 | 473/157 |
| 6,939,240 | B2 * | 9/2005 | Daley | A63B 63/007 | 473/180 |

(Continued)

*Primary Examiner* — Mark S Graham

(57) ABSTRACT

A golf putting training device with a portable golf hole cut through a unique multidimensional triangular shaped device, in which the longest edge of the triangle is flat and can lay flush on an underlying surface and receive a golf ball smoothly. The device will have one corner of the triangle that is elevated creating one highest point sloping down to two low or flat points, or one flat edge. The device has two functional faces or bases that are the mirror images of each other. The device can be flipped over and rest on either of the two largest faces (or triangular surface areas) to allow a practicing golfer to practice striking putts that break right to left, or left to right. The device can be positioned relative to the practicing golfer in such a manner that many different slope degrees or angles can change the break of the putt, even a slope that provides for a perfectly straight putt.

1 Claim, 4 Drawing Sheets

(56) References Cited

U.S. PATENT DOCUMENTS

| | | | | |
|---|---|---|---|---|
| 7,255,648 | B1 * | 8/2007 | Romeo | A63B 57/357<br>473/180 |
| 8,951,135 | B1 * | 2/2015 | Guyer | A63B 67/02<br>473/153 |
| 2004/0152529 | A1 * | 8/2004 | Chen | A63B 67/02<br>473/159 |

* cited by examiner

3-IN-1 GOLF CUP

This application claims the benefit of U.S. Provisional Application No. 62/466,845, filed Mar. 3, 2017.

BACKGROUND

The game of golf involves hitting a golf ball with a hand-held piece of equipment specific to the sport. After several shots, the golf ball is hit into a hole that measures 4.25" in diameter. This process is completed with a piece of equipment called a putter. The process itself is called putting. For any person who plays the sport of golf, learning to putt better is vital to improving one's game. Putting comprises around 40% of the total shots an avid golfer may hit in an 18-hole round of golf. The ability to properly execute a putting stroke requires much training. Throughout the course of an 18-hole round of golf the majority of the putts a golfer will strike will not be on perfectly flat ground. This means the ball will not always move towards the hole, on the ground surface called the putting green, in a straight line. The ability to putt a ball that moves from left to right, right to left, or straight are all very important skills that a golfer must practice in order to improve their overall golf game.

Putting training aids have been on the market for a considerable amount of time and are used by a great multitude of golfers. They are often used for training to develop a sound, consistent putting stroke and develop confidence so that the player can perform well on the golf course.

The majority of putting training aids on the market are designed with a golf hole cut into a thicker than flat material. Some of them have raised edges that are flexible, or open on one side to allow a golf ball to travel into the cup and remain in there when contacting an edge. These devices are designed to provide a realistic putting experience to the user off the golf course, in the home, office or other place. Nearly every putting training device on the market is designed for the user to strike a putt that moves straight.

The idea of a practice putting device that allows the golfer to putt a ball that breaks, or moves in a line not straight, while allowing the end user to also practice putts that do move straight is far more practical, because during the course of a round of golf the player will encounter putts that are straight, putts that move left to right, and putts that move right to left.

A putting training aid that enables the golfer to practice putts that break left to right, right to left and that are straight is a far better practice tool than a device that only allows a golfer to practice straight putting.

The market has some affordable, simple, easy to use and innovative golf mats, and cups. The market is sorely lacking a golf cup training aid that has a simple design, is inexpensive to obtain, and easy to use which allows the golfer to practice striking putts that break. The market is specifically lacking a device to assist golfers in practicing putts that move right to left, left to right and putts that go straight that is extremely simple, inexpensive and easy to use.

U.S. patent Ser. No. 10/762,692, granted to Daley, discloses a putting cup apparatus designed to more accurately reproduce a regulation putting cup.

U.S. patent Ser. No. 08/296,681, granted to Schindler, discloses a device that can be used for putting practice that has upward curved outer walls that receive a golf ball into a cup that resembles a regulation golf hole U.S. patent Ser. No. 11/269,472 discloses a ramp shaped practice putting apparatus designed to help with a golfer's putting speed. Said disclosure is a rectangular platform that is designed for assisting a practicing golfer in striking a putt that goes in a straight line to the golf hole.

The market has fallen short in producing a simple, inexpensive, exemplary designed golf putting training device that allows the end user to practice hitting putts that break, and putts that move straight.

BRIEF SUMMARY OF THE INVENTION

There is a need for a device that is designed to be simple to use, and inexpensive, that enables a golfer to practice putts that break right to left, left to right and that move straight.

An object of this invention is to provide an optimally designed golf training device that allows a golfer to practice his or her putting stroke with the ability to hit straight, or breaking putts that move right to left or left to right, and can end in a hole similar to a regulation golf hole.

Another object of this invention is to provide a golf hole that is shaped as a triangular wedge having 4 vertices, 4 faces, and 6 edges. Said triangular wedge is designed to rest upon one of its two larger faces. These 2 larger faces, when turned or flipped over, are the mirror image of each other having identical shape and surface area, also having an identical degree of slope; however, the slope will move in opposite directions.

Another object of this invention is to provide a golf hole that is optimally designed so as to make it simple for a golfer to practice hitting putts that move right to left, left to right and straight. Whereas said device can, and where the object is, for the ball to land in a hole that is substantially similar, albeit with less depth, to a golf hole that you find on a golf course. This hole will have no bottom and go completely through the device to provide a hole on both faces of the device.

Another object of this invention is to provide a triangular wedge, with a golf hole all the way through both of the largest surface area faces of the device, that allows the practicing golfer to hit putts that move from right to left when said device is resting on the ground with its tallest point, or tallest edge, pointing substantially upward (although not at a 90° angle) and located at the rear right side in relation to the position of the golfer.

Another object of this invention is to provide a triangular wedge that when flipped or turned over from resting upon one of its largest surface area faces to the other identical surface area face, will result in an identical mirror image allowing the golfer to hit putts that move from left to right with the tallest point, or edge, facing substantially upward (but not at a 90° angle) in the rear left in relation to the golfer.

Another object of the disclosed invention is to provide a triangular wedge that can be turned, no matter what side or surface it is resting on, as long as the flat edge is facing the golfer, so that the downward grade of the slope is facing directly at the golfer, and the flat edge is also facing the golfer, allowing the golfer to practice straight putts. The tallest point of the triangular wedge will be at the rear and near the mid region of the device relative to the position of the practicing golfer.

DETAILED DESCRIPTION AND SPECIFICATION OF INVENTION

Figure 1:
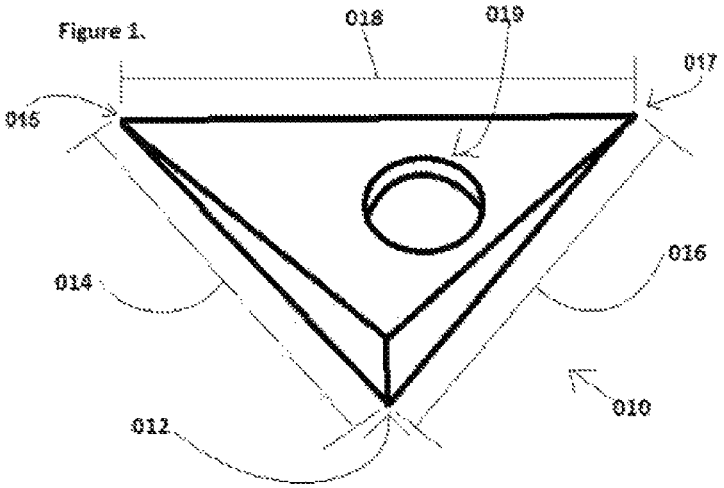
FIG. 1 shows a view of the golf hole putting device from behind. This view allows you to see the two sides of the triangular shape that are sloped down from one elevated vertex, the tallest point of the device, to two separate points, or vertexes, that are flat. Both of the sloped edges meet at one flat point. You can see that both flat points connect and produce a long flat edge that can receive a golf ball without a bump or lip. This edge or side of the triangle is the longest of the three sides.

FIG. 1 discloses the device 010 from an angle that is above and behind the tallest portion, or edge, of the invention, 012. 012 represents the shortest edge of the device. 012 has two vertices and will always be facing upward as the device is designed to rest on one of its two larger faces. To the right of 012, which is the highest point of the device, the device runs downhill to a completely flat point, or vertex, 017, creating the back side face of the device 016. In FIG. 1, to the left of edge 012, the device runs downhill to a flat point or vertex, 015, creating the side face of the device 014. The two aforementioned flat points or vertices, 015 and 017, connect to form edge 018. 018 is the flat side of the device that has no lip and is designed to allow a golf ball to travel onto the device in a smooth manner, without a bump or break in the flow of the putt. The golf hole, which will resemble a regulation golf hole apart from having less depth, is noted as 019. This hole is not cut directly in the center of the device as seen in FIG. 1. The hole is cut close to side or face 016 and is in a centrally located position relative to rear side 016. This is a position that will leave roughly equidistant lengths from cup center to edge 012 and cup center to vertex or point 017. The positioning of the golf hole here allows for ample space between the hole and face or side 014 to allow the golf ball space and distance to move along the sloped grade of the device, creating a putt that breaks.

Figure 2:
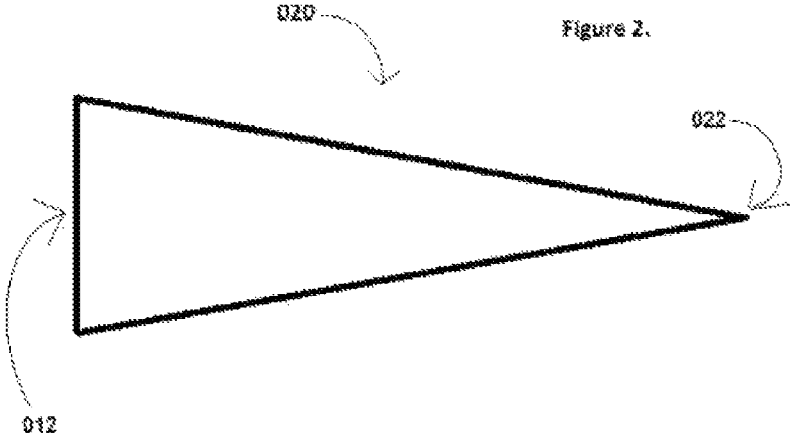
FIG. 2 illustrates a side view of what could be either of the graded sides of the device. These sides represent the two smaller surface area faces of the device. This picture is not to scale but shows accurately how either sloped side would look if the highest point of the mound, 012, were at a right angle to the ground. This would cause the flat point 022 to rise from the ground at what would be the mid-point of 012. This shows part of the symmetry of this invention and the design that makes it a mirror image when flipped over from resting on one side to the other.

FIG. 2 discloses a close-up view of just one side or face of the device, but is representative of both of the smaller faces of the device. FIG. 2 label 020 can represent either face 014 or 016. This picture demonstrates either side, 014 or 016, where point 012 is perpendicular, or at a right angle, relative to the surface upon which it is resting. Point 022, which is a representation of either point/vertex 015 or 017, is elevated off the surface on which the device would be resting. When 012 is at a right angle to the ground, you can see that 022 (the representation of 014 or 016) will be off the flat underlying surface at a position that is halfway up 012. Each side, 014 and 016, is designed this way, although these sides may or may not be the same size.

Figure 3:
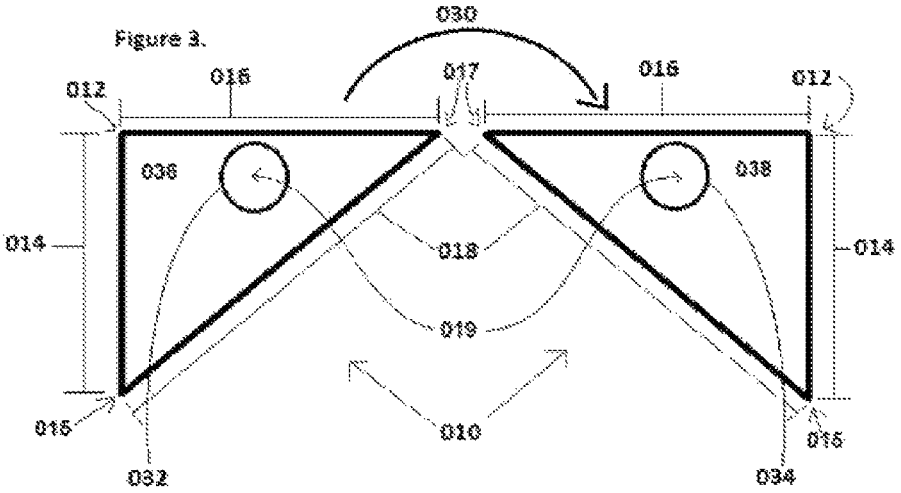
FIG. 3 illustrates the same device resting on each of the two larger surface area faces of the device. The view is from directly above the device. In this illustration the practicing golfer would be below the pictures practicing putts that move from left to right, and that move from right to left. The curved arrow at the top indicates the turning over of the device so that the mirror image of the left picture is produced. The flat edge, upon which the golf ball enters the device, in each picture, moves backward away from the golfer diagonally. On the left it moves away from the end user diagonally left to right. On the right picture it moves away from the end user diagonally right to left.

FIG. 3 illustrates the unique versatility of the device 010. FIG. 3 is a top view angle. Part 036 is one of the two larger faces of the device. 036 represents the entire surface area encompassed within points 012, 015 and 017. 038 also represents the second of the two larger faces of the device. 038 represents the entire surface area encompassed between points 012, 015 and 017 on the other side of the device in relation to face 036. This device is designed to always be resting on one of these two faces, 036 or 038, while the other is pointed up whereby the golf ball will travel upon said face. When surface 036 is facing up, then surface 038 is contacting the floor. When surface 038 is facing up, then surface 036 is contacting the floor. Surfaces 036 and 038 are mirror images of each other with identical dimensions. 036 and 038 have identical slopes from point 012 downwards toward edge 018, but in opposite directions.

FIG. 3 discloses the device, 010, resting on the ground on both faces of the device, 036 and 038. The left view, with surface 036 facing up, is the mirror image of the right view, where surface 038 is facing up. 032 represents a line showing the approximate golf ball path when putted onto the device, 010. 032 represents the approximate golf ball path when side 036 is facing up and side 038 is resting flush on the floor. 032 represents the path of a putted golf ball crossing edge 018 onto device 010 moving from left to right on surface 036 towards golf hole 019. Line 032 represents the path the golf ball will travel when edge 012 is in the rear left, relative to the golfer's position.

034 also shows the approximate golf ball path when putted onto the device, 010. Line 034 represents the approximate golf ball path when side 038 is facing up and side 036 is resting flush on the floor. Line 034 represents the approximate path of a putted golf ball crossing edge 018 onto device 010 moving from right to left on surface 038 towards golf hole 019. 034 represents the path the golf ball will travel when edge 012 is in the rear right relative to the position of the golfer.

In FIG. 3, line 030 represents flipping the device over from having surface 036 facing up and 038 down, to having surface 038 facing up and 036 facing down. In both pictures face 016 remains in the rear of the device relative to the practicing golfer. Face 014 goes from being on the left-hand side in the picture with surface 036 facing up to the right-hand side in the picture where surface 038 is facing up, relative to the practicing golfer. Flat edge 018 goes from moving backwards diagonally from point 015 to point 017 in a left to right direction when surface 036 is facing up to a left to right backwards diagonal direction from point 015 to point 017 when surface 038 is facing up.

Figure 4:
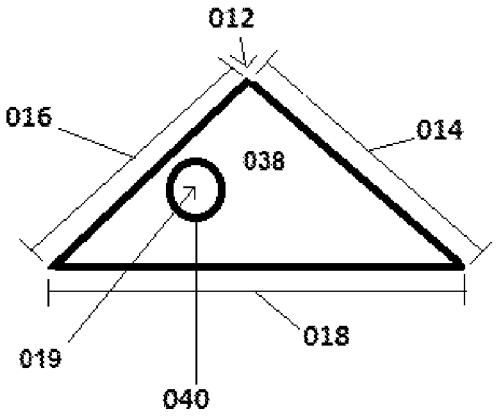
FIG. 4 shows the device from a top view directly over the device. This picture illustrates what the device looks like when attempting a straight putt, from a position at the bottom of the picture.

FIG. 4 is an illustration of a top down view of the device, 010, being re-positioned so that the downward slope of the device is moving directly towards the practicing golfer, who would be at the bottom of the page. Point 012, the tallest of the 3 points or vertices, of the triangular device seen in FIG. 4, is located at the back of the device in relation to the practicing golfer. In this illustration line 040 represents a putted golf ball moving across edge 018 onto surface 038 moving in a straight line uphill to golf hole, 019. This creates the ability for the practicing golfer to practice hitting straight putts. It does not matter which surface, 036 or 038, is facing up. Either surface can be facing up when a practicing golfer wishes to use device 010 to practice putts that are straight, with no break or movement right to left or left to right.

The triangular wedge, 010, can be made by casting flexible foam (or other materials, 1 part or 2 part, that begin as liquid and turn solid such as rigid foam, rubber, plastic, fiberglass, etc.) into a mold that has an inside part that contacts the casted material, formed from such materials as silicone rubber, fiberglass mat and resin, fiberglass gel coat, plastic or other materials that make mold release possible. The inner dimensions of the mold are identical to the outer dimensions of the device. Another method of creating the device is to start with a solid material, such as foam, or rubber or plastic, etc. and cut and shape it down into the desired device dimensions.

The device 010 is an optimal embodiment of an efficiently designed, easy to use, golf cup putting trainer that serves the purpose of receiving golf balls into a golf hole. The embodiment further serves to receive golf balls that can be putted on a line that moves left to right, right to left or straight.

The device, 010, can be placed directly onto a floor, preferably a carpeted floor, or can be affixed loosely underneath a piece of AstroTurf, or similar carpeting, with a hole cut into it at one end that is the exact dimension of the hole in the device. The device, 010, can also be permanently affixed in between two pieces of turf (or like carpeting) that are connected by their undersides so that the turf can be flipped over and the device will create the desired mirror effect enabling the golfer to practice left to right, and right to left putts. The last mentioned purpose would however prevent the practicing golfer from striking putts that move straight.

The invention claimed is:

1. The invention claimed is a practice putting cup comprising: two larger faces, that both act as the top of the device that receives the putted golf ball or the bottom that rests on the ground by flipping the device over, enabling the practicing golfer to hit putts onto the device that break or go straight with the effect that the different sides will provide for ball movement in opposite directions relative to a hole that each face has in it; two smaller faces that act as the side or rear of the device depending upon which large face the device is resting upon; one circular face surrounding the hole in the device; eight edges, four of which border both the two smaller and two larger faces, two circular edges that border the hole in the large faces, one edge, the shortest, that borders only the two smaller faces and represents the device's apex when resting upon either of the two larger faces, and one edge, the front and longest, that borders only both large faces that can be positioned at different angles or perpendicular relative to the practicing golfer, is flush with the surface it is resting upon, and is the entry point for receiving the putted golf ball onto the device; four angular points, or vertices; the hole larger than 1.68 inches in diameter, formed, or cut all the way through the entire device in both large faces and generally located in a position far enough away from one smaller face to leave space for a golf ball to move right to left left to right, or go straight upon entering the device on its way toward the hole.

* * * * *